US011161315B2

(12) United States Patent
Chiu et al.

(10) Patent No.: US 11,161,315 B2
(45) Date of Patent: Nov. 2, 2021

(54) PRESS MACHINE

(71) Applicant: Corex Materials Corporation, Taichung (TW)

(72) Inventors: Shao-Chen Chiu, Taichung (TW); Cheng-Feng Yang, Taichung (TW)

(73) Assignee: Corex Materials Corporation, Taichung (TW)

( * ) Notice: Subject to any disclaimer, the term of this patent is extended or adjusted under 35 U.S.C. 154(b) by 261 days.

(21) Appl. No.: 16/459,694

(22) Filed: Jul. 2, 2019

(65) Prior Publication Data

US 2020/0215778 A1 Jul. 9, 2020

(30) Foreign Application Priority Data

Jan. 8, 2019 (TW) ..... 108100727

(51) Int. Cl.

| | |
|---|---|
| ***B30B 1/18*** | (2006.01) |
| ***B30B 15/06*** | (2006.01) |
| ***B30B 11/00*** | (2006.01) |
| ***B30B 15/02*** | (2006.01) |
| ***B30B 7/04*** | (2006.01) |

(52) U.S. Cl.

CPC ..... *B30B 1/18* (2013.01); *B30B 7/04* (2013.01); *B30B 11/007* (2013.01); *B30B 15/026* (2013.01); *B30B 15/062* (2013.01)

(58) Field of Classification Search

CPC ..... B30B 1/18; B30B 1/181; B30B 15/062; B30B 15/064; B30B 15/02; B30B 15/022; B30B 11/02; B30B 11/007; B30B 7/04

See application file for complete search history.

(56) References Cited

U.S. PATENT DOCUMENTS

| | | | | |
|---|---|---|---|---|
| 3,647,332 A * | 3/1972 | Schmaus | B30B 11/02 425/78 |
| 3,772,987 A * | 11/1973 | Difley | B30B 9/306 100/290 |
| 4,011,810 A * | 3/1977 | Santic | B30B 9/3042 100/229 A |
| 9,533,436 B2 * | 1/2017 | Pannewitz | B30B 15/044 |
| 2009/0317507 A1 * | 12/2009 | Eisenberg | B30B 1/18 425/406 |

* cited by examiner

*Primary Examiner* — Jimmy T Nguyen

(74) *Attorney, Agent, or Firm* — Alan D. Kamrath; Karin L. Williams; Mayer & Williams PC

(57) ABSTRACT

A press machine has a body, a lower pressing assembly, and an upper pressing assembly. The body has a first driving device, a second driving device, at least one first supporting rod, and at least one second supporting rod. The at least one first supporting rod is rotatably connected to the first driving device. The at least one second supporting rod is rotatably connected to the second driving device. The lower pressing assembly is movably mounted with the at least one first supporting rod of the body. The upper pressing assembly is movably mounted with the at least one second first supporting rod of the body, and is able to move toward the lower pressing assembly.

8 Claims, 6 Drawing Sheets

PRESS MACHINE

BACKGROUND OF THE INVENTION

1. Field of the Invention

The present invention relates to a press machine, and more particularly to a press machine which has two movable press molds to improve working efficiency of the press machine.

2. Description of Related Art

A conventional press machine comprises a body, a fixed press mold, and an active press mold. The fixed press mold is fixed with the body. The active press mold is movably mounted to the body above the fixed press mold. A worker may place a workpiece on the fixed press mold. Then the worker may operate the conventional press machine to enable the active press mold to move downwardly toward the fixed press mold, and eventually the active press mold would press the workpiece along with the fixed press mold.

However, the conventional press machine has the following shortcoming. A stroke of a pressing operation of the conventional press machine is completed by the active press mold. That takes the worker much time to await the movement of the active press mold. So the conventional press machine is not efficient enough.

SUMMARY OF THE INVENTION

The main objective of the present invention is to provide a press machine that can improve working efficiency. The press machine comprises two movable press molds to share a stroke of a pressing operation of the press machine so as to solve the problem of inefficiency of the conventional press machine.

The press machine in accordance with the present invention has a body, a lower pressing assembly, and an upper pressing assembly. The body has a first driving device, a second driving device, at least one first supporting rod, and at least one second supporting rod. The at least one first supporting rod is rotatably connected to the first driving device. The at least one second supporting rod is rotatably connected to the second driving device. The lower pressing assembly is movably mounted with the at least one first supporting rod of the body. The upper pressing assembly is movably mounted with the at least one second first supporting rod of the body, and is able to move toward the lower pressing assembly.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
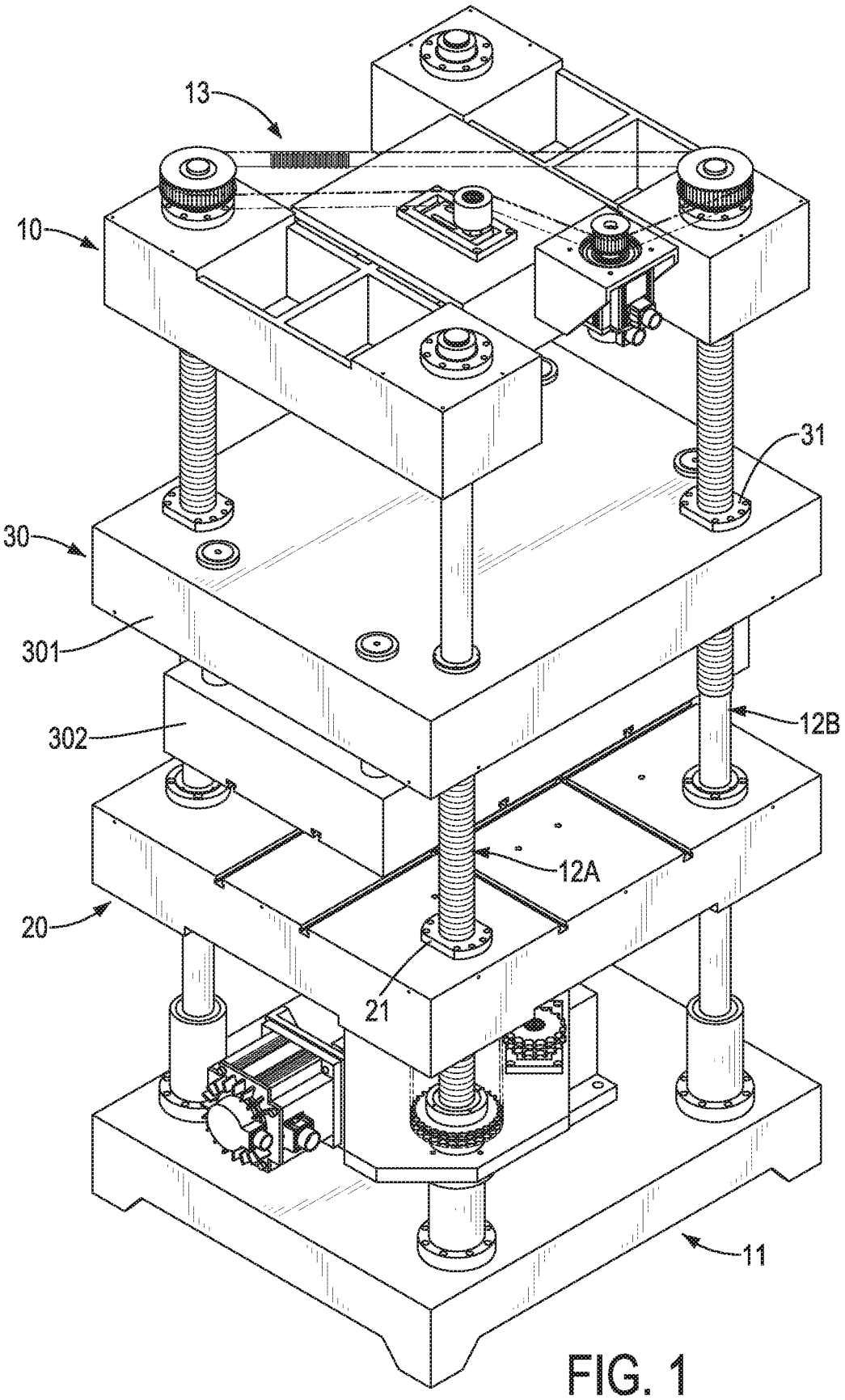
FIG. 1 is a perspective view of a press machine in accordance with the present invention.
Figure 2:
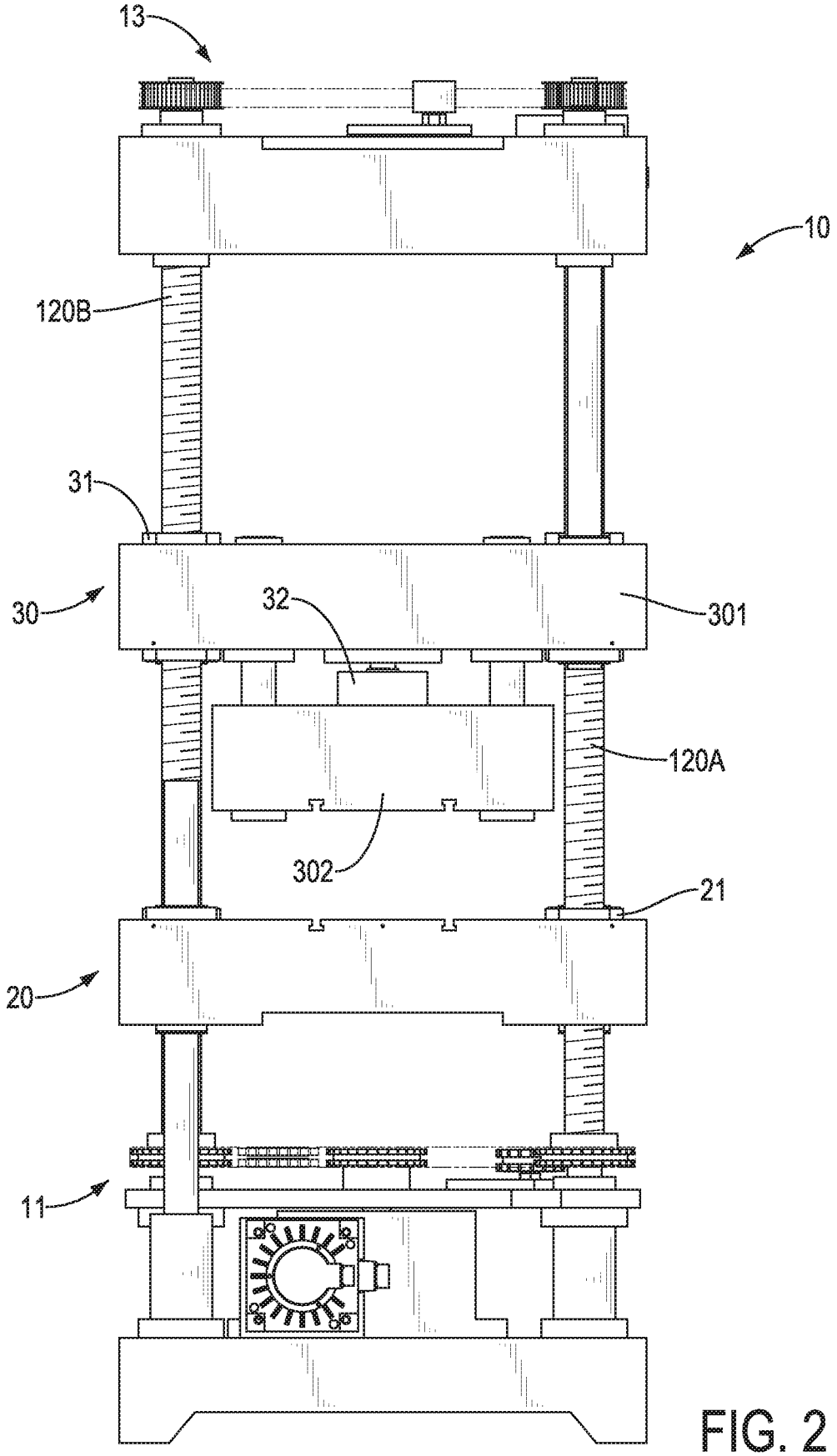
FIG. 2 is a side view of the press machine in FIG. 1.
Figure 3:
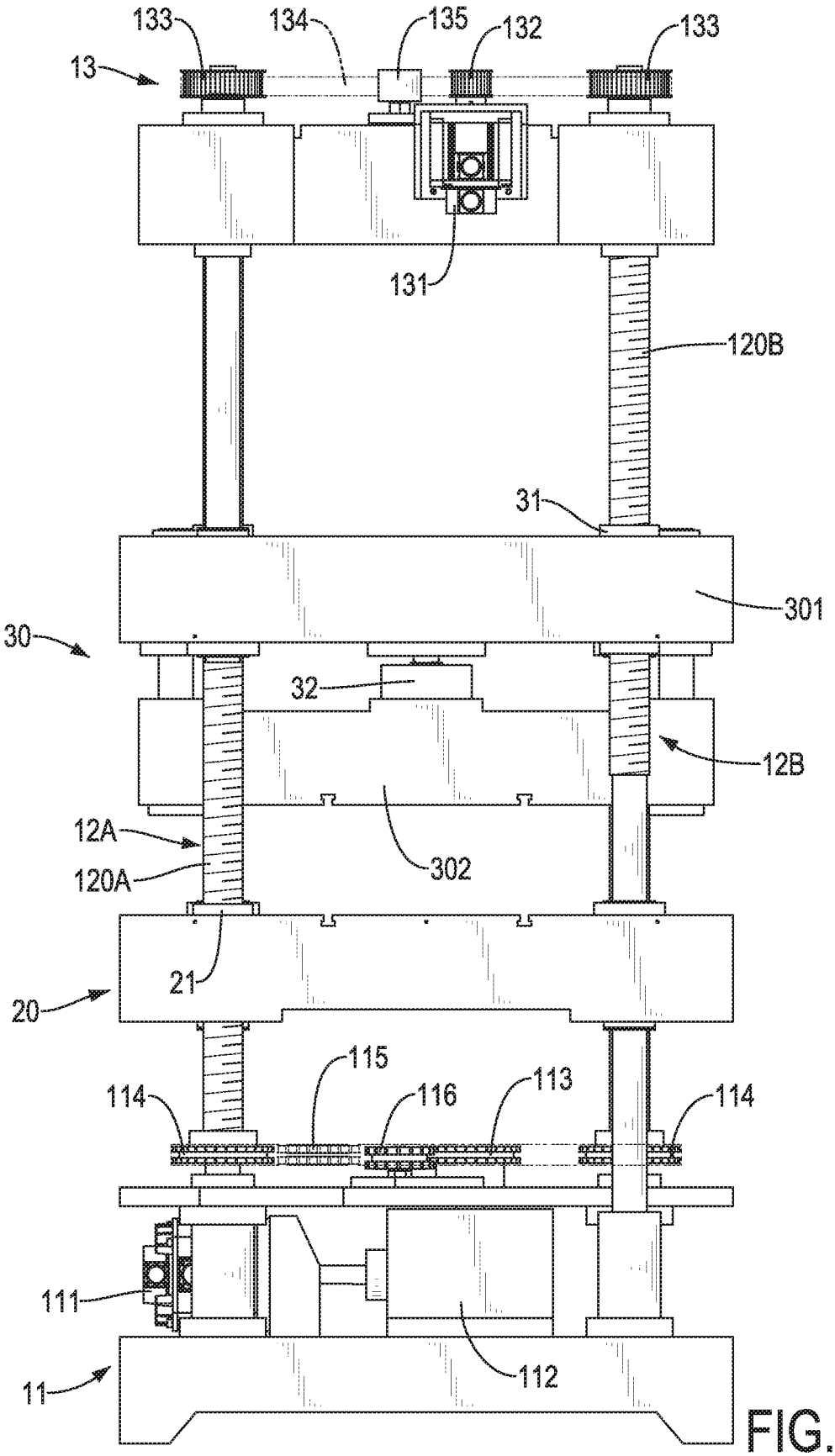
FIG. 3 is another side view of the press machine in FIG. 1.

With reference to FIGS. 1 to 3, a press machine in accordance with the present invention comprises a body 10, a lower pressing assembly 20, and an upper pressing assembly 30.

With reference to FIGS. 1 to 3, the body 10 has a bottom, a top, a first driving device 11, multiple supporting rods 12A, 12B, and a second driving device 13. The first driving device 11 is located on the bottom of the body 10. The multiple supporting rods 12A, 12B are connected to the first driving device 11 at spaced intervals, and extend uprightly. The multiple supporting rods 12A, 12B comprise at least one first supporting rod 12A and at least one second supporting rod 12B. With further reference to FIG. 1, in the present invention, the multiple supporting rods 12A, 12B are composed of two said first supporting rods 12A and two said second supporting rods 12B. The four supporting rods 12A, 12B are arranged at four corners of the body 10, respectively. Furthermore, the two first supporting rods 12A are disposed diagonally. Similarly, the two second supporting rods 12B are disposed diagonally as well. Each one of the two first supporting rods 12A has a lower thread portion 120A disposed near a bottom end of the first supporting rod 12A. Each one of the second supporting rods 12B has an upper thread portion 120B disposed near a top end of the second supporting rod 12B. The second driving device 13 is located on the top of the body 10, is connected with the multiple supporting rods 12A, 12B, and is located above the first driving device 11.

Figure 4:
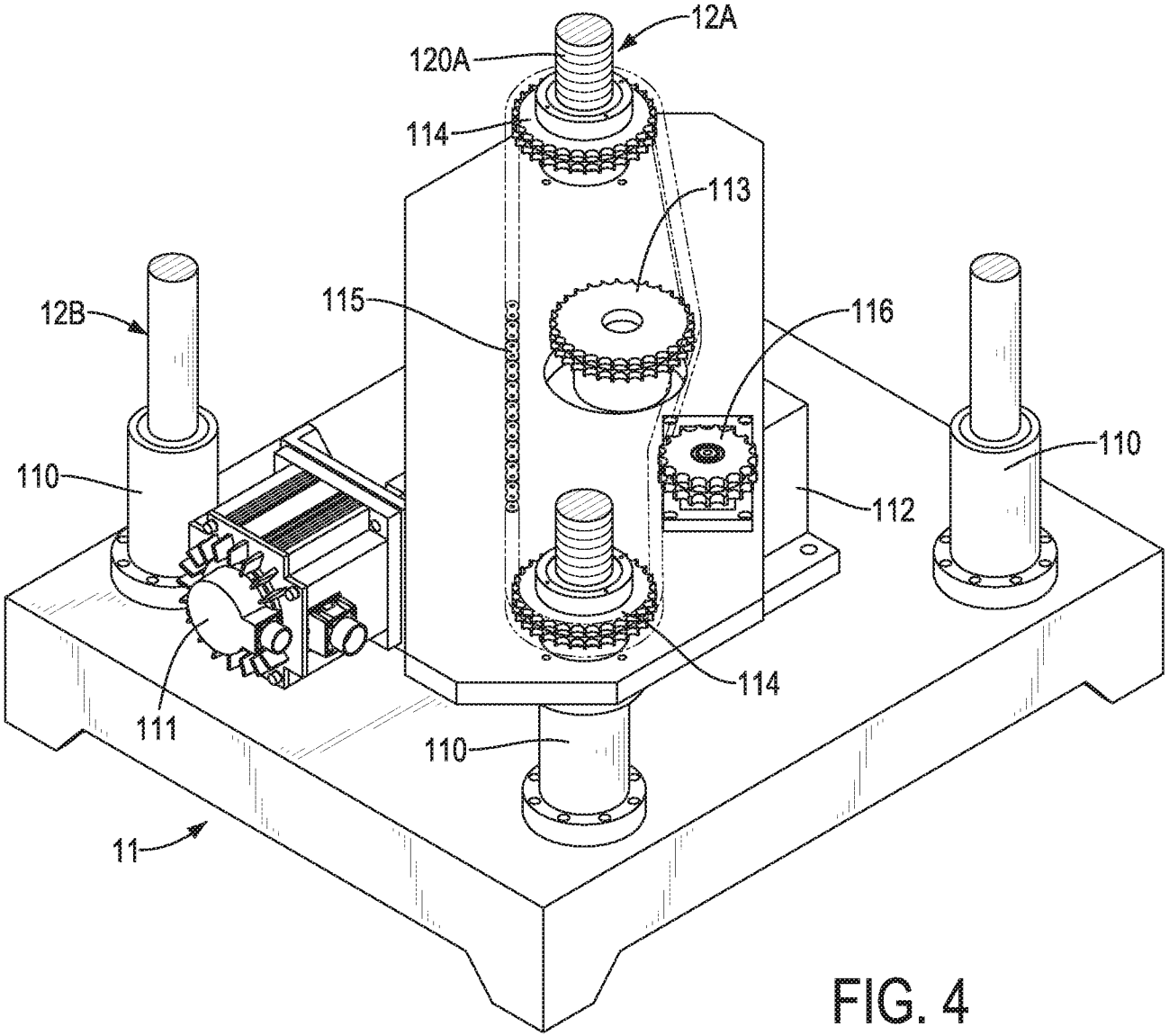
FIG. 4 is an enlarged perspective view of a first driving device of the press machine in FIG. 1.

With reference to FIGS. 3 and 4, the first driving device 11 has four bases 110, a first driving motor 111, a decelerator 112, a first driving component 113, at least one first transmission component 114, a first transmitter 115, and a first idler 116. Each one of the four bases 110 is connected to a respective one of the four supporting rods 12A, 12B, and the four supporting rods 12A, 12B are rotatable about axes of the four bases 110 respectively. The decelerator 112 is connected with the first driving motor 111. The first driving component 113 is fixed to a shaft of the decelerator 112, so a driving force provided by the first driving motor 111 may turn the first driving component 113 via the decelerator 112.

The at least one first transmission component 114 is fixed to the at least one first supporting rod 12A. In the present invention, the first driving device 11 has two said first transmission components 114. The two first transmission components 114 are respectively fixed to the two first supporting rods 12A, and are connected to the first driving component 113. The first transmitter 115 meshes with the first driving component 113 and the two first transmission components 114. As a result, revolutions of the first driving components 113 would cause the two first transmission components 114 and the two first supporting rods 12A to rotate via the first transmitter 115. The first idler 116 is a component mounted near and abutting the first transmitter 115. In the present invention, the first transmitter 115 may be a chain, and the first driving component 113, the two transmission components 114, and the first idler 116 may be sprockets accordingly to mesh with the chain.

Figure 5:
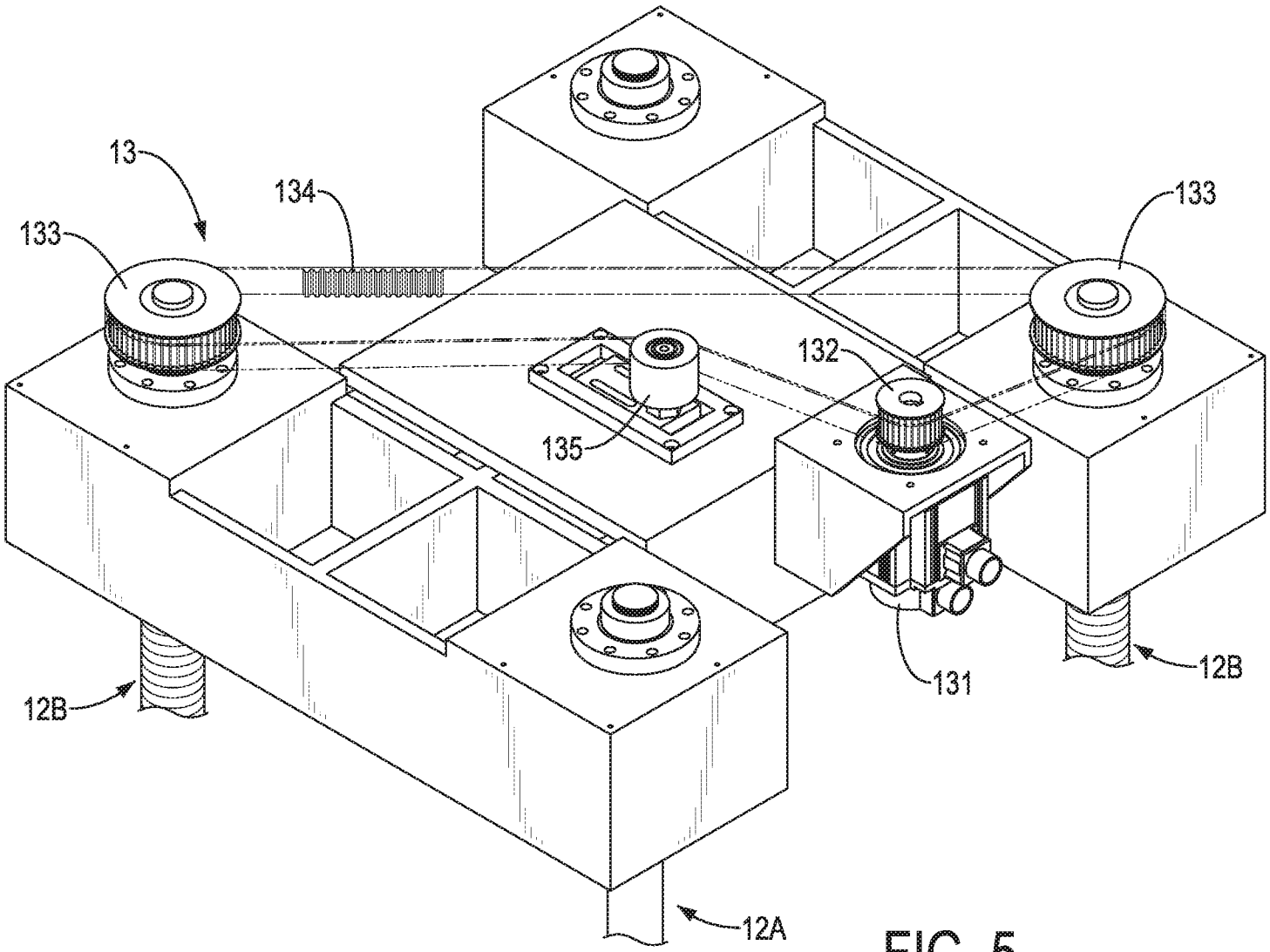
FIG. 5 is an enlarged perspective view of a second driving device of the press machine in FIG. 1.

With reference to FIGS. 3 and 5, the second driving device 13 has a second driving motor 131, a second driving component 132, at least one second transmission component 133, a second transmitter 134, and a second idler 135. The second driving component 132 is fixed to a shaft of the second driving motor 131, and is thereby driven by the second driving motor 131. The at least one second transmission component 133 is fixed to the at least one second supporting rod 12B. In the present invention, the second driving device 13 has two second transmission components 133. Each one of the two second transmission components 133 is fixed with a respective one of the two second supporting rods 12B, and the two second transmission components 133 are connected to the second driving component 132. The second transmitter 134 meshes with the second driving component 132 and the two second transmission components 133. As a result, a driving force provided by the second driving motor 131 may rotate the two second transmission components 133 and the two second supporting rods 12B. Besides, the second idler 135 is a component mounted near and abutting the second transmitter 134. In the present invention, the second transmitter 134 is a timing belt, and the second driving component 132 and the two second transmission components 133 are timing pulleys that mesh with the timing belt.

With reference to FIGS. 1 to 3, the lower pressing assembly 20 is a lower press mold, and is movably mounted with the multiple supporting rods 12A, 12B. The lower pressing assembly 20 has at least one sliding component 21. The at least one first sliding component 21 is mounted with the at least one first supporting rod 12A. In the present invention, the lower pressing assembly 20 has two first sliding components 21 slidably sleeved on the lower thread portions 120A of the two first supporting rods 12A, respectively. Each one of the two first sliding components 21 and a respective one of the two first supporting rods 12A work as an interactive combination of a screw rod and a slider. Thereby the lower pressing assembly 20 may move vertically via the two first sliding components 21 while the two first supporting rods 12A are rotated by the first driving device 11.

The upper pressing assembly 30 comprises a connector 301, an upper press mold 302, at least one second sliding component 31, and a pressure gauge 32. The connector 301 is movably mounted with the multiple supporting rods 12A, 12B. The upper press mold 302 is connected to the connector 301, and is located between the connector 301 and the lower pressing assembly 20.

The at least one second sliding component 31 is mounted with the at least one second supporting rod 12B. In the present invention, the upper pressing assembly 30 has two second sliding components 31 sleeved on the upper thread portions 120B of the two second supporting rods 12B, respectively. Each one of the two second sliding components 31 and a respective one of the two second supporting rods 12B work as an interactive combination of a screw rod and a slider. Thereby the upper pressing assembly 30 may move vertically via the two second sliding components 31 while the two second supporting rods 12B are rotated by the second driving device 13. The pressure gauge 32 is disposed on a side of the upper press mold 302 away from the lower pressing assembly 20, and is located between the upper press mold 302 and the connector 301. The pressure gauge 32 may be utilized to measure pressure when the upper press mold 302 presses on the lower pressing assembly 20.

Figure 6:
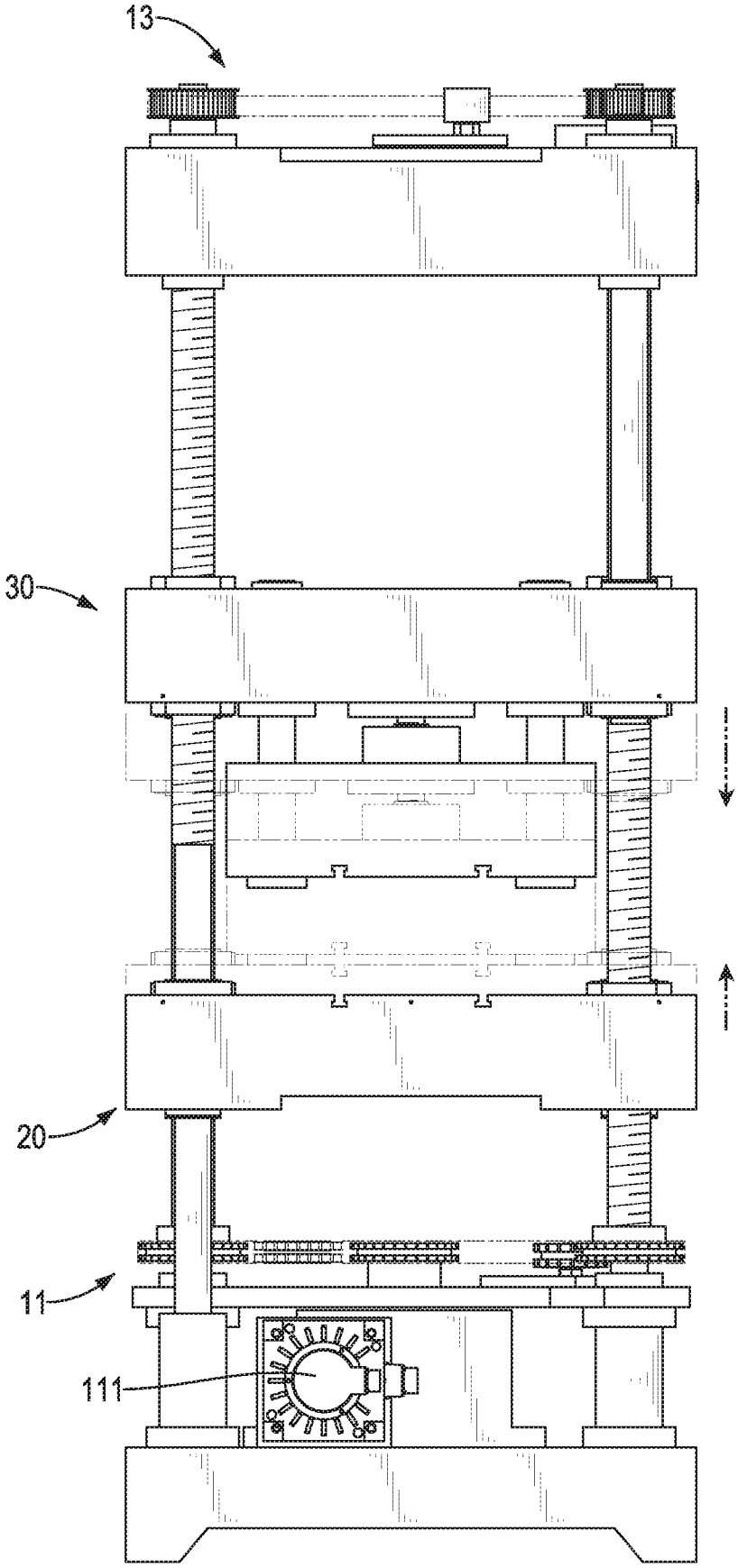
FIG. 6 is an operational side view of the press machine in FIG. 1.

With the aforementioned technical features, the press machine in accordance with the present invention provides efficient pressing operations that are under small tons, e.g. under 300 tons. With reference to FIG. 6, by controlling the first driving motor 111 and the second driving motor 131, the lower pressing assembly 20 would be moved upwardly, and the upper pressing assembly 30 would be moved downwardly. The lower pressing assembly 20 and the upper pressing assembly 30 together finish a stroke of pressing operation of the press machine, wherein a distance completed by the upper pressing assembly 30 is larger than a distance completed by the lower pressing assembly 20. Therefore, the efficiency of the press machine of the present invention may be higher than that of the conventional press machine, which utilizes the active press mold solely to complete the stroke. In the present invention, the overall stroke of the press machine is 500 millimeters. The distance completed by the lower pressing assembly 20 is 50 millimeters, and the distance completed by the upper pressing assembly 30 is 450 millimeters. Other than reducing operation time, the technical features may also improve precision of pressure offered by the press machine by coordinating movements of the lower pressing assembly 20 and the upper pressing assembly 30.

Besides, in comparison with mounting the upper press mold 302 directly on the multiple supporting rods 12A, 12B, the connector 301 may increase a weight of the upper pressing assembly 30 and provide a larger strength of the mechanical structure thereby.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A press machine comprising:

a body having a first driving device;

a second driving device;

two first supporting rods rotatably connected to the first driving device; and two second supporting rods rotatably connected to the second driving device, wherein the two first supporting rods and the two second supporting rods are disposed at spaced intervals;

a lower pressing assembly movably mounted with the two first supporting rods of the body; and an upper pressing assembly movably mounted with the two second supporting rods of the body, and being able to move toward the lower pressing assembly; wherein the first driving device has a first driving motor;

a first driving component being a sprocket and connected to the first driving motor;

two first transmission components each being a sprocket, the two first transmission components fixed to the two first supporting rods respectively, and connected with the first driving component; and a first transmitter being a chain and meshing with the first driving component and the two first transmission components;

the second driving device has a second driving motor;

a second driving component being a timing pulley and connected to the second driving motor;

two second transmission components each being a timing pulley, the two second transmission components fixed to the two second supporting rods respectively, and connected to the second driving component; and a second transmitter being a timing belt and meshing with the second driving component and the two second transmission components.

2. The press machine as claimed in claim 1, wherein each one of the two first supporting rods has a lower thread portion; and the lower pressing assembly has two first sliding components and each one of the two first sliding components is slidably mounted with the lower thread portion of a respective one of the two first supporting rods.

3. The press machine as claimed in claim 1, wherein each one of the two second supporting rods has an upper thread portion; and the upper pressing assembly has two second sliding components, and each one of the two first sliding components is slidably mounted with the upper thread portion of a respective one of the two second supporting rods.

4. The press machine as claimed in claim 2, wherein each one of the two second supporting rods has an upper thread portion; and the upper pressing assembly has two second sliding components, and each one of the two first sliding components is slidably mounted with the upper thread portion of a respective one of the two second supporting rods.

5. The press machine as claimed in claim 1, wherein the upper pressing assembly has a connector mounted with the two second supporting rods; and an upper press mold connected to the connector, and located between the connector and the lower pressing assembly.

6. The press machine as claimed in claim 2, wherein the upper pressing assembly has a connector mounted with the two second supporting rods; and an upper press mold connected to the connector, and located between the connector and the lower pressing assembly.

7. The press machine as claimed in claim 3, wherein the upper pressing assembly has a connector mounted with the two second supporting rods; and an upper press mold connected to the connector, and located between the connector and the lower pressing assembly.

8. The press machine as claimed in claim 4, wherein the upper pressing assembly has a connector mounted with the two second supporting rods; and an upper press mold connected to the connector, and located between the connector and the lower pressing assembly.

* * * * *